US008803931B2

(12) United States Patent
Moto

(10) Patent No.: US 8,803,931 B2
(45) Date of Patent: Aug. 12, 2014

(54) THERMAL HEAD AND THERMAL PRINTER INCLUDING THE SAME

(75) Inventor: Yoichi Moto, Kirishima (JP)

(73) Assignee: Kyocera Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 14/001,392

(22) PCT Filed: Feb. 24, 2012

(86) PCT No.: PCT/JP2012/054578

§ 371 (c)(1),
(2), (4) Date: Aug. 23, 2013

(87) PCT Pub. No.: WO2012/115231

PCT Pub. Date: Aug. 30, 2012

(65) Prior Publication Data

US 2013/0328988 A1 Dec. 12, 2013

(30) Foreign Application Priority Data

Feb. 25, 2011 (JP) ..... 2011-040088

(51) Int. Cl.
*B41J 2/335* (2006.01)

(52) U.S. Cl.
CPC ..... *B41J 2/335* (2013.01); *B41J 2/3353* (2013.01)
USPC ..... 347/203

(58) Field of Classification Search
USPC ..... 347/200, 202, 203, 204, 205, 206, 208
See application file for complete search history.

(56) References Cited

U.S. PATENT DOCUMENTS

2006/0098052 A1 5/2006 Inokuma
2009/0174758 A1 7/2009 Yamada et al.

FOREIGN PATENT DOCUMENTS

JP 04-112048 * 4/1992 ..... B41J 2/335
JP 081155 U 7/1996
JP 2004195947 7/2004
JP 2006150758 A 6/2006
JP 2006181822 A 7/2006
JP 2009184175 A 8/2009

OTHER PUBLICATIONS

English translation of International Preliminary Report on Patentablity dated Aug. 27, 2013.*
International Search Report, PCT/JP2012/054578, Mar. 30, 2012, 2 pp.

* cited by examiner

*Primary Examiner* — Huan Tran
(74) *Attorney, Agent, or Firm* — Volpe and Koenig, P.C.

(57) ABSTRACT

A thermal head capable of reducing abrasion of the conductive layer and reducing damage of heat-generating portions is provided. A thermal head includes a substrate, a plurality of heat-generating portions disposed on or above the substrate, electrodes provided on or above the substrate and electrically connected to the plurality of heat-generating portions, and a protective layer provided along an arrangement direction of the plurality of heat-generating portions, the protective layer covering the plurality of heat-generating portions and the electrodes. The protective layer has an electrical insulating layer covering the plurality of heat-generating portions and the electrodes, a conductive layer provided on the electrical insulating layer, and an abrasion resistance layer provided on the conductive layer. Part of the conductive layer is an exposed portion exposed from the abrasion resistance layer.

18 Claims, 12 Drawing Sheets

THERMAL HEAD AND THERMAL PRINTER INCLUDING THE SAME

FIELD OF INVENTION

The present invention relates to a thermal head and a thermal printer including the same.

BACKGROUND

Various types of thermal heads have been heretofore proposed as printing devices for a facsimile, a video printer and so on. For example, a thermal head described in Patent Literature 1 includes a substrate, a plurality of heat-generating portions disposed on or above the substrate and electrodes connected to the plurality of heat-generating portions. The plurality of heat-generating portions and the electrodes are covered by a protective film, and a conductive layer is further formed over the protective film. Then, part of the conductive layer contacts the electrodes. Accordingly, static electricity generated in a medium on which printing is performed can be relieved to the electrodes through the conductive layer on the protective film in the thermal head described in Patent Literature 1.

CITATION LIST

Patent Literature

Patent Literature 1: Japanese Unexamined Patent Publication JP-A 2006-181822

SUMMARY

Technical Problem

However, as the medium is carried while contacting the conductive layer positioned on the heat-generating portions at the time of printing in the thermal head described in Patent Literature 1, there is a problem that the conductive layer is abraded and the protective film on the heat-generating portions is exposed. When the conductive layer is abraded in this manner, there is a possibility that the medium does not contact the conductive layer and the protective film exposed on the heat-generating portions is dielectrically broken down due to static electricity accumulated in the medium to thereby damage the heat-generating portions.

Solution to Problem

A thermal head according to an embodiment of the invention includes a substrate, a plurality of heat-generating portions disposed on or above the substrate, electrodes provided on or above the substrate and electrically connected to the plurality of heat-generating portions and a protective layer provided along an arrangement direction of the plurality of heat-generating portions, the protective layer covering the plurality of heat-generating portions and the electrodes. Moreover, the protective layer has an electrical insulating layer covering the plurality of heat-generating portions and the electrodes, a conductive layer provided on the electrical insulating layer, and an abrasion resistance layer provided on the conductive layer. Furthermore, part of the conductive layer is an exposed portion exposed from the abrasion resistance layer.

Advantageous Effects of Invention

According to the invention, it is possible to provide a thermal head and a thermal printer including the same capable of reducing abrasion of the conductive layer and reducing damage of the heat-generating portions.

DETAILED DESCRIPTION OF THE PREFERRED EMBODIMENTS

Figure 1:
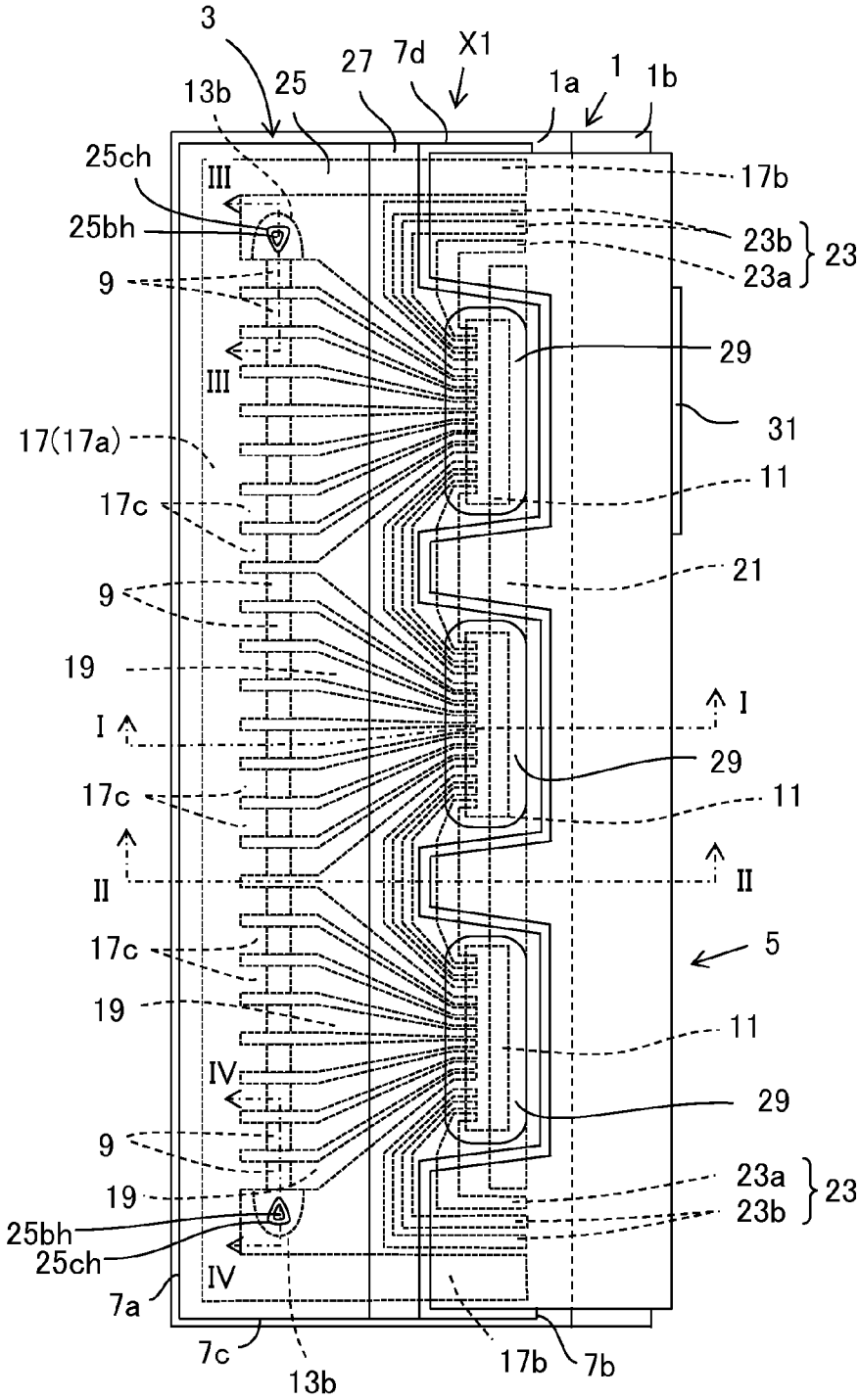
FIG. 1 is a plan view showing a thermal head according to an embodiment of the invention.
Figure 2:
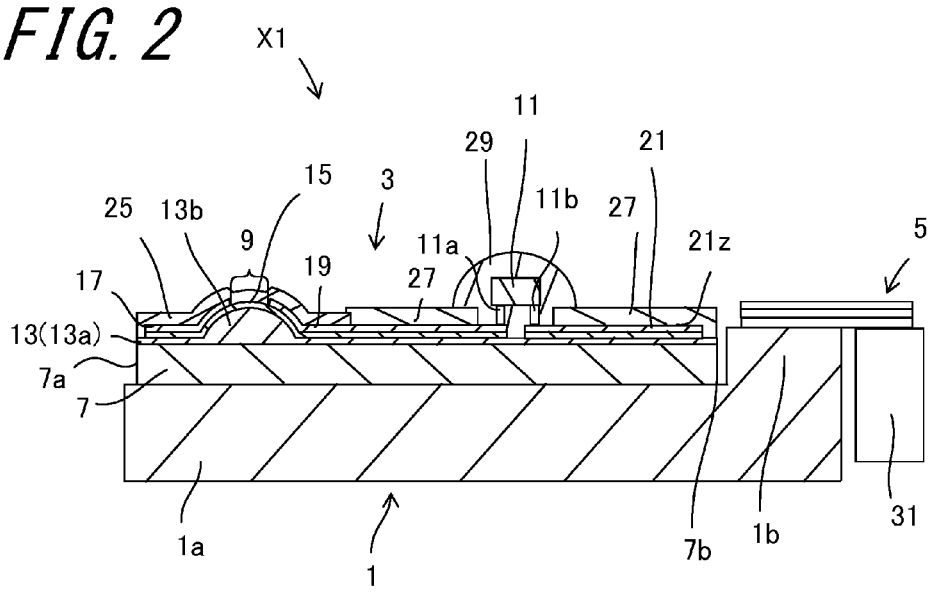
FIG. 2 is a cross-sectional view of the thermal head shown in FIG. 1 taken along the line I-I.
Figure 3:
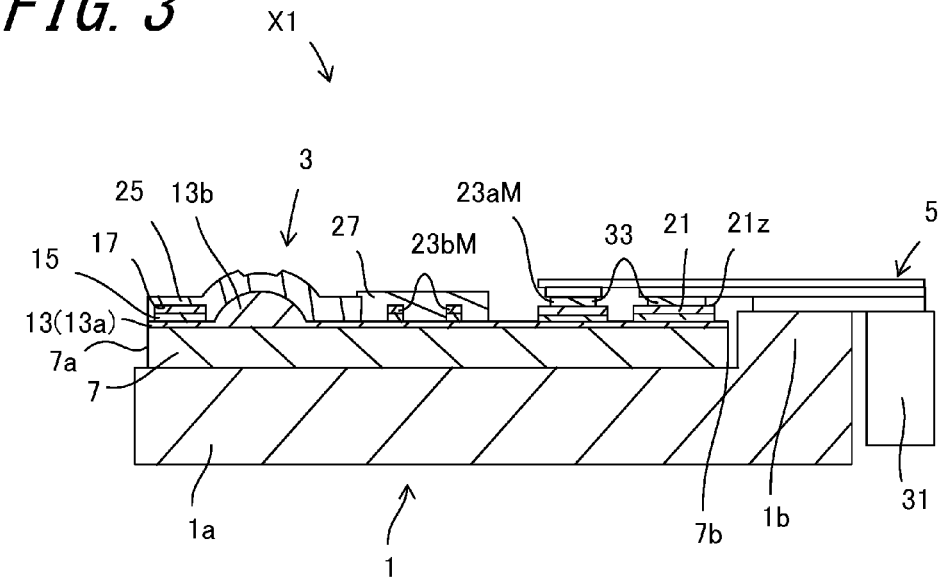
FIG. 3 is a cross-sectional view of the thermal head shown in FIG. 1 taken along the line II-II.

Hereinafter, a thermal head according to an embodiment of the invention will be explained with reference to the drawings. As shown in FIGS. 1 to 3, a thermal head X1 of the present embodiment includes a heat dissipating member 1, a head base 3 disposed on the heat dissipating member 1 and a flexible printed circuit board 5 (hereinafter referred to as a FPC 5) connected to the head base 3.

The heat dissipating member 1 is made of, for example, a metal material such as copper or aluminum, including a bedplate portion la having a rectangular shape and a protruding portion 1*b* extending along one long side of the bedplate portion 1*a*. As shown in FIG. 2, the head base 3 is bonded to an upper surface of the bedplate portion 1*a* other than the protruding portion 1*b* by a double-faced tape, adhesives or the like (not shown). The FPC 5 is bonded on the protruding portion 1*b* by the double-faced tape, adhesives or the like (not shown). The heat dissipating member 1 has a function of dissipating part of heat not contributed to printing in heat generated at heat-generating portions 9 of the head base 3 as described later.

As shown in FIGS. 1 to 5, the head base 3 includes a substrate 7 having a rectangular shape in a plan view, a plurality of heat-generating portions 9 provided on the substrate 7 and arranged along a longitudinal direction of the substrate 7 and a plurality of driver ICs 11 arranged side by side on the substrate 7 along an arrangement direction of the heat-generating portions 9 (hereinafter may be referred to as an arrangement direction).

The substrate 7 is made of an electric insulating material such as alumina ceramics, a semiconductor material such as monocrystalline silicon.

Figure 5:
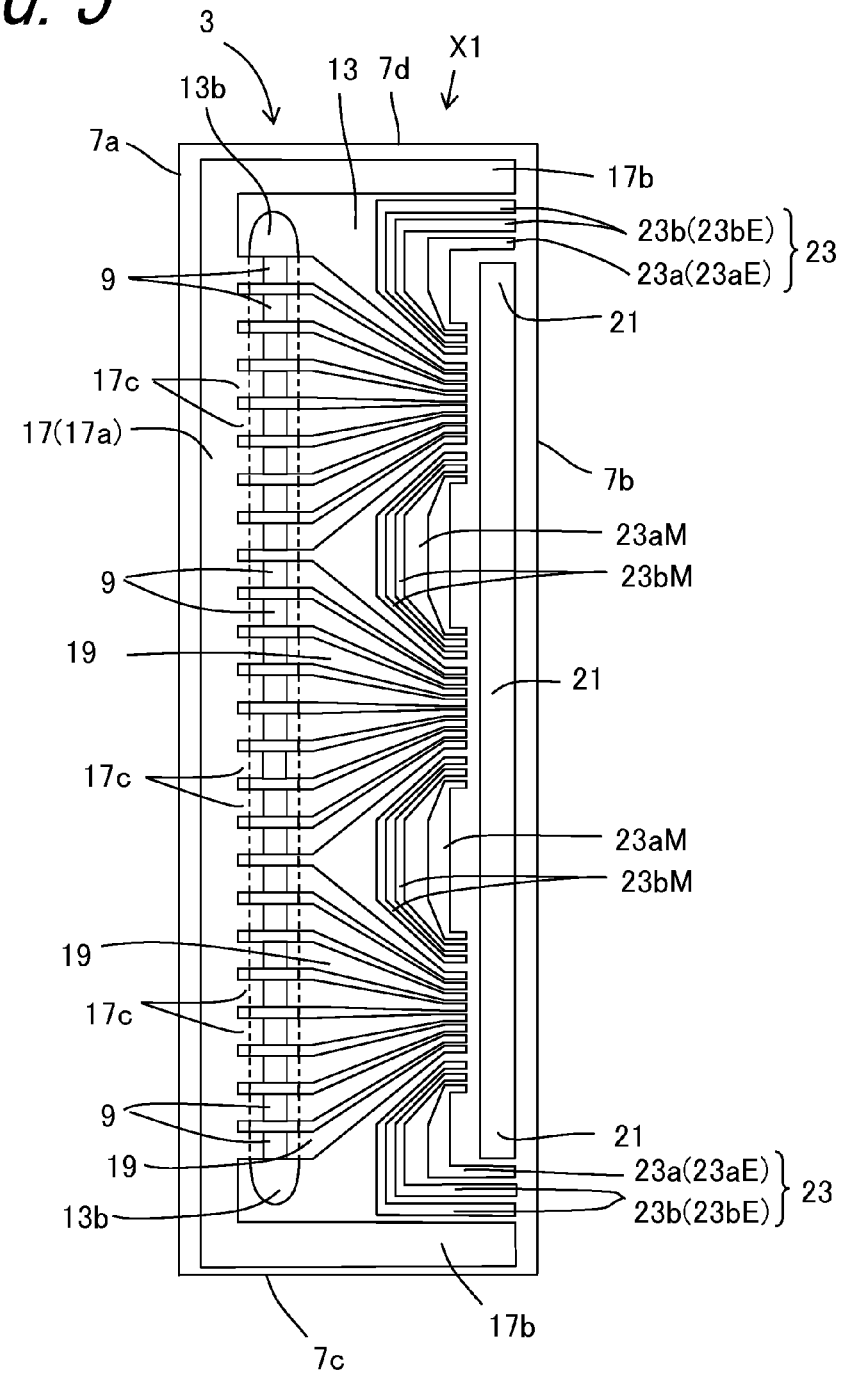
FIG. 5 is a plan view of the head base of FIG. 4 in which a first protective layer, a second protection film, driver ICs and a covering member are not shown.

As shown in FIGS. 2, 3 and 5, the thermal storage layer 13 is formed on an upper surface of the substrate 7. The thermal storage layer 13 has a base layer 13*a* and a raised portion 13*b*. The base layer 13*a* is formed over the entire upper surface of the substrate 7. The raised portion 13*b* is partially raised from the base portion 13*a*, extending along the arrangement direction of the plurality of heat-generating portions 9 in a band shape and having an approximately semi-elliptical shape in cross section. The raised portion 13*b* has a function of pressing a medium to be printed against a first protective layer 25 formed on the heat-generating portions 9 in good condition.

The thermal storage layer 13 can be made of, for example, glass having low thermal conductivity and temporarily accumulates part of heat generated in the heat-generating portions 9. Accordingly, the thermal storage layer 13 functions so as to shorten the time necessary for increasing the temperature of the heat-generating portions 9 and so as to increase thermal response characteristics of the thermal head X1. The glass for forming the thermal storage layer 13 is formed by, for example, applying a predetermined glass paste obtained by mixing a suitable organic solvent into glass powder by using a well-known screen printing or the like and filing the resultant at a high temperature.

Examples of the glass for forming the thermal storage layer 13 include glass containing $SiO_2$, $Al_2O_3$, CaO and BaO, glass containing $SiO_2$, $Al_2O_3$ and PbO, glass containing $SiO_2$, $Al_2O_3$ and BaO, and glass containing SiO2, B2O3, PbO, $Al_2O_3$, CaO and MgO.

An electric resistor layer 15 is provided on an upper surface of the thermal storage layer 13. The electric resistor layer 15 is interposed between the thermal storage layer 13 and a later-descried common electrode 17, individual electrodes 19, a ground electrode 21 and IC-control electrodes 23. The electric resistor layer 15 has regions having the same shapes of these individual electrodes 19, the common electrode 17, the ground electrode 21 and the IC-control electrodes 23 in a plan view as shown in FIG. 5 (hereinafter referred to as interposed regions). The electric resistor layer 15 has also a plurality of regions exposed from between the individual electrodes 19 and the common electrode 17 (hereinafter referred to as exposed regions). Note that the interposed regions of the electric resistor layer 15 are hidden by the common electrode 17, the individual electrodes 19, the ground electrode 21 and the IC-control electrodes 23 in FIG. 5.

The respective exposed regions of the electric resistor layer 15 form the heat-generating portions 9. The plurality of heat-generating portions 9 are arranged in a line on the raised portion 13*b* of the thermal storage layer 13 as shown in FIGS. 2 and 5. The plurality of heat-generating portions 9 are shown in a simple manner for convenience of explanation in FIGS. 1, 4 and 5, which are disposed in a density of, for example, 180 dpi to 2400 dpi (dot per inch) and so on.

The electric resistor layer 15 is made of a material having relatively high electric resistance such as a TaN-based, a TaSiO-based, a TaSiNO-based, a TiSiO-based, a TiSiCO-based or a NbSiO-based material. Accordingly, when a voltage is applied between the common electrode 17 and the individual electrodes 19, and electric current is supplied to the heat-generating portions 9, the heat-generating portions 9 generate heat due to Joule heat.

As shown in FIGS. 1 to 6, the common electrode 17, the individual electrodes 19, the ground electrode 21 and the IC-control electrodes 23 are provided on or above an upper surface of the electric resistor layer 15, more specifically, on or above an upper surface of the interposed regions. These common electrode 17, the individual electrodes 19, the ground electrode 21 and the IC-control electrodes 23 are made of a material having conductivity, which is, for example, at least one kind of metal selected from aluminum, gold, silver and copper or an alloy thereof.

The common electrode 17 has a main wiring portion 17*a*, sub-wiring portions 17*b* and lead portions 17*c* as shown in FIG. 5. The main wiring portion 17*a* extends along one long side 7*a* of the substrate 7. The sub-wiring portions 17*b* respectively extend along one short side 7*c* and the other short side 7*d* of the substrate 7, one end portions of which are connected to the main wiring portion 17*a*. The lead portions 17*c* individually extend toward the respective heat-generating portions 9 from the main wiring portion 17*a*. Then, the other end portions of the sub-wiring portions 17*b* are connected to the FPC 5 as well as tip portions of the lead portions 17*c* are connected to the heat-generating portions 9. Accordingly, the FPC 5 and the heat-generating portions 9 are electrically connected.

Figure 6:
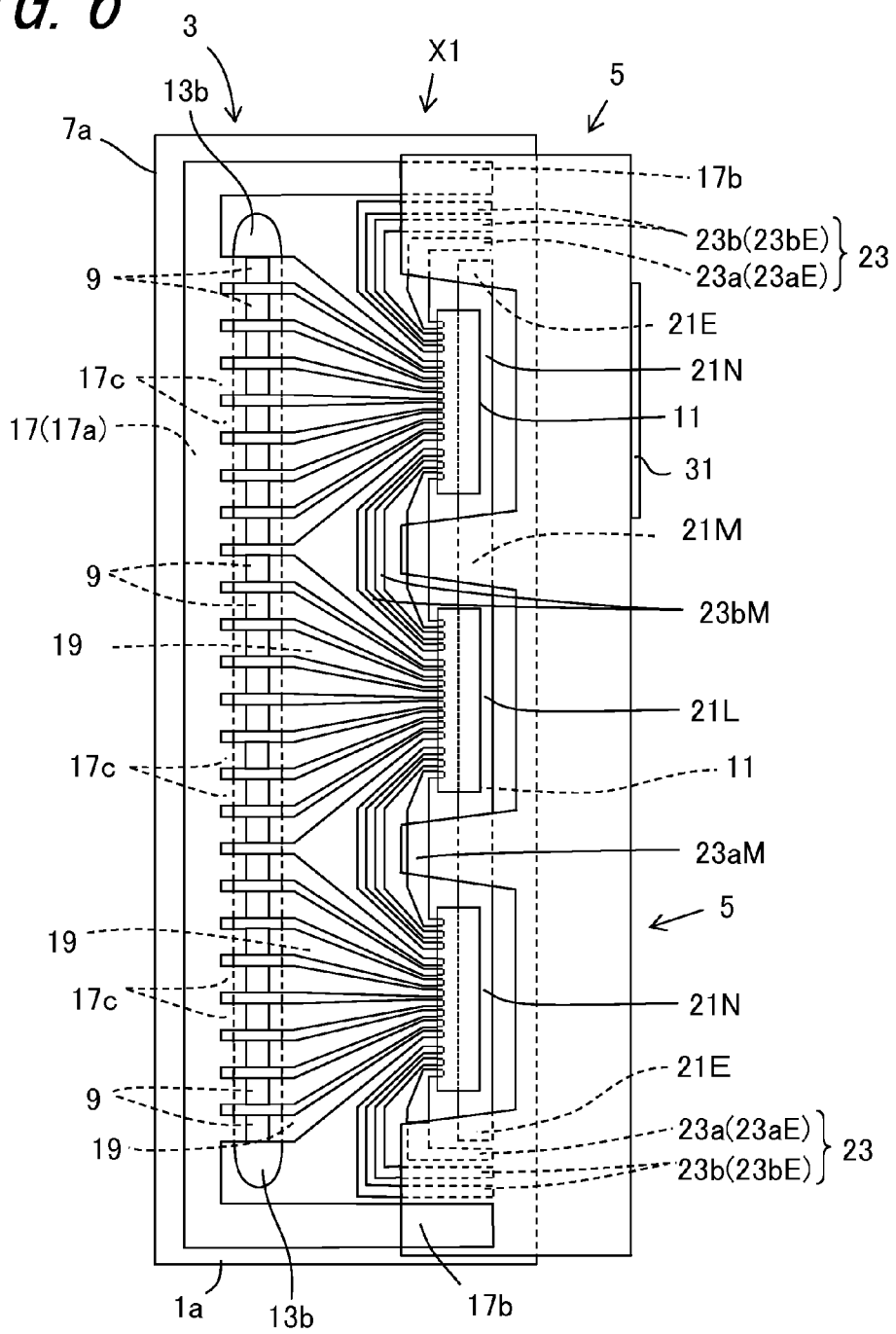
FIG. 6 is a plan view showing a state where an external substrate is connected to the head base in which the first protective layer, the second protection film, and the covering member are not shown.

The individual electrodes 19 extend to between the respective heat-generating portions 9 and the driver ICs 11, electrically connecting respective heat-generating portions 9 to the driver ICs 11 as shown in FIGS. 2 and 6. In more detail, the individual electrodes 19 divide the plurality of heat-generating portions 9 into plural groups, and electrically connect the heat-generating portions 9 in the respective groups to the driver ICs 11 provided so as to correspond to the respective groups.

The ground electrode 21 extends along the arrangement direction in the vicinity of the other long side 7*b* of the substrate 7 in a band shape as shown in FIG. 5. The FPC 5 and the driver ICs 11 are connected onto the ground electrode 21 as shown in FIGS. 3 and 6. In more detail, the FPC 5 is connected to end regions 21E positioned at one and the other end portions of the ground electrode 21 as shown in FIG. 6. The FPC 5 is also connected to first intermediate regions 21M of the ground electrode 21 positioned between adjacent driver ICs 11. In the embodiment, the above common electrode 17, the individual electrodes 19 and the ground electrode 21 correspond to electrodes in the invention.

The driver IC 11 is connected to a second intermediate region 21N positioned between the end region 21E and the first intermediate region 21M of the ground electrode 21. The driver IC 11 is also connected to a third intermediate region 21L positioned between adjacent first intermediate regions 21M. Accordingly, the driver ICs 11 and the FPC 5 are electrically connected.

The driver ICs 11 are disposed so as to correspond to the respective groups of the plurality of heat-generating portions 9 and are connected to one end portions of the individual electrodes 19 and the ground electrode 21 as shown in FIG. 6. The driver ICs 11 are provided for controlling a conducting state of the respective heat-generating portions 9 and include a plurality of switching devices thereinside as described later. Then, as the driver ICs 11, well-known ones becoming conductive when the respective switching devices are in an on-state and becoming non-conductive when respective switching devices are in an off-state can be used. As shown in FIG. 2, one connection terminals 11*a* (hereinafter referred to as first connection terminals 11*a*) of the respective driver ICs 11 connected to the switching devices (not shown) provided thereinside are connected to the individual electrodes 19. The other connection terminals 11*b* (hereinafter referred to as second connection terminals 11*b*) connected to the switching devices are connected to the ground electrode 21. Accordingly, when the respective switching devices of the driver ICs 11 are in the on-state, the individual electrodes 19 and the ground electrode 21 which are connected to respective switching devices are electrically connected.

A plurality of first connection terminals 11*a* connected to the individual electrodes 19 and a plurality of second connection terminals 11*b* connected to the ground electrode 21 are provided so as to correspond to the respective individual electrodes 19, though not shown. The plurality of first connection terminals 11*a* are individually connected to respective individual electrodes 19. The plurality of second connection terminals 11*b* are connected to the ground electrode 21 in common.

The IC control electrodes 23 are provided for controlling the driver ICs 11, having IC power electrodes 23*a* and IC signal electrodes 23*b* as shown in FIGS. 5 and 6. The IC power electrodes 23*a* include end-portion power electrode portions 23*a*E and intermediate power electrode portions 23*a*M. The end-portion power electrode portions 23*a*E are disposed in the vicinity of the other long side 7*b* of the substrate 7 at both end portions in the longitudinal direction of the substrate 7. The intermediate power electrode portions 23*a*M are disposed between adjacent driver ICs 11, electrically connecting adjacent driver ICs 11.

As shown in FIG. 6, the end-portion power electrode portion 23*a*E is disposed so that one end portion is arranged at an arrangement region of the driver IC 11 and the other end portion is arranged in the vicinity of the other long side 7*b* of the substrate 7 in a manner of being drawn around the grand electrode 21. The end-portion power electrode portion 23*a*E is disposed so that one end portion is connected to the driver IC 11 and the other end portion is connected to the FPC 5. Accordingly, the driver ICs 11 are electrically connected to the FPC 5.

As shown in FIG. 6, the intermediate power electrode portion 23*a*M extends along the ground electrode 21, one end portion is arranged at an arrangement region of one of adjacent driver ICs 11 and the other end portion is arranged at an arrangement region of the other of adjacent driver ICs 11. The intermediate power electrode portion 23*a*M is disposed so that one end portion is connected to one of adjacent driver ICs 11, the other end portion is connected to the other of adjacent driver ICs 11, and an intermediate portion is connected to the FPC 5 (refer to FIG. 3). Accordingly, the driver ICs 11 are electrically connected to the FPC 5.

The end-portion power electrode portion 23*a*E and the intermediate power electrode portion 23*a*M are electrically connected to each other inside the driver IC 11 to which both portions are connected. The adjacent end-portion power electrode portions 23*a*M are electrically connected to each other inside the driver IC 11 to which both portions are connected.

As described above, the IC power electrodes 23*a* electrically connect between respective driver ICs 11 and the FPC 5 by connecting the IC power electrodes 23*a* to respective driver ICs 11. Accordingly, the thermal head X1 supplies electric current from the FPC 5 to the respective driver ICs 11 through the end-portion power electrode portions 23*a*E and the intermediate power electrode portions 23*a*M as described later.

The IC signal electrodes 23*b* include end-portion signal electrode portions 23*b*E and intermediate signal electrode portions 23*b*M as shown in FIGS. 5 and 6. The end-portion signal electrode portions 23*b*E are disposed in the vicinity of the other long side 5*b* of the substrate 7 at both end portions in the longitudinal direction of the substrate 7. The center signal electrode portions 23*b*M are disposed between adjacent driver ICs 11.

As shown in FIG. 6, the end-portion signal electrode portion 23*b*E is disposed so that one end portion is arranged at the arrangement region of the driver IC 11 and the other end portion is arranged in the vicinity of the right long side of the substrate 7 in a manner of being drawn around the grand electrode 21 in the same manner as the end-portion power electrode portion 23*a*E. The end-portion signal electrode portion 23*b*E is disposed so that one end portion is connected to the driver IC 11 and the other end portion is connected to the FPC 5.

The intermediate signal electrode portion 23*b*M is disposed so that one end portion is arranged at an arrangement region of one of adjacent driver ICs 11 and the other end portion is arranged at an arrangement region of the other of adjacent driver ICs 11 in a manner of being drawn around the intermediate power electrode portion 23*a*M. The intermediate signal electrode portion 23*b*M is disposed so that one end portion is connected to one of adjacent driver ICs 11 and the other end portion is connected to the other of adjacent driver ICs 11.

The end-portion signal electrode portion 23*b*E and the intermediate signal electrode portion 23*b*M are electrically connected to each other inside the driver IC 11 to which both portions are connected. The adjacent end-portion signal electrode portions 23*b*M are electrically connected to each other inside the driver IC 11 to which both portions are connected.

As described above, the IC signal electrodes 23*b* electrically connect between the respective driver ICs 11 and the FPC 5 by connecting the IC signal electrodes 23*b* to the respective driver ICs 11. Accordingly, a control signal transmitted from the FPC 5 to the driver IC 11 through the end-portion signal electrode portion 23*b*E is further transmitted to the adjacent driver IC 11 through the intermediate signal electrode portion 23*b*M as described later.

The above-described electric resistor layer 15, the common electrode 17, the individual electrodes 19, the ground electrode 21 and IC-control electrodes 23 are formed by, for example, sequentially stacking material layers forming the respective components on the thermal storage layer 13 by using, for example, a well-known thin-film forming technique such as sputtering, then, processing a stacked body into a predetermined pattern by using a well-known photolithography technique, an etching technique or the like.

As shown in FIGS. 2 and 3, the first protective layer 25 covering the heat-generating portions 9, part of the common electrode 17 and part of the individual electrodes 19 is formed on the thermal storage layer 13 formed on the upper surface of the substrate 7. In the shown example, the first protective layer 25 is provided along the arrangement direction so as to cover a region of approximately the left half of the upper surface of the thermal storage layer 13. In the embodiment, the first protective layer 25 corresponds to a protective layer in the invention.

Figure 7:
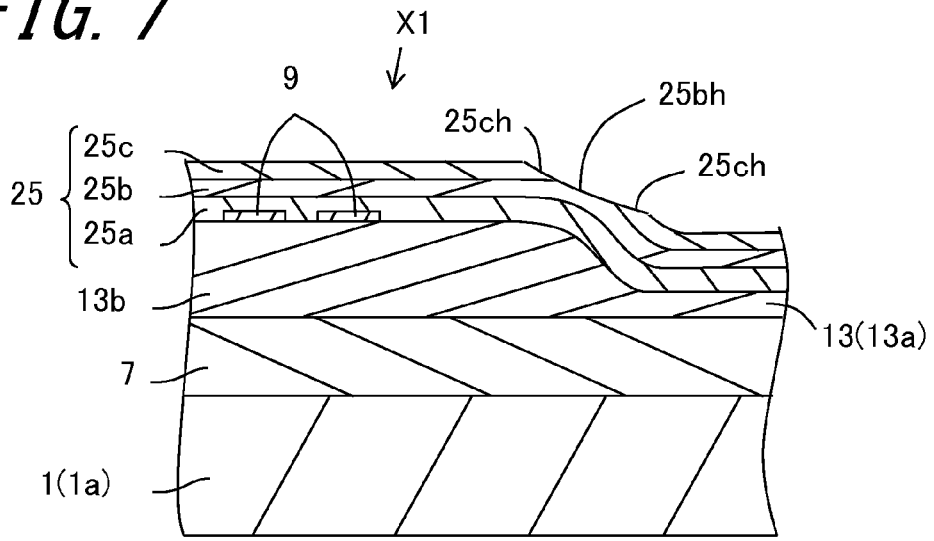
FIG. 7 is a cross-sectional view of the thermal head shown in FIG. 1 taken along the line III-III.
Figure 8:
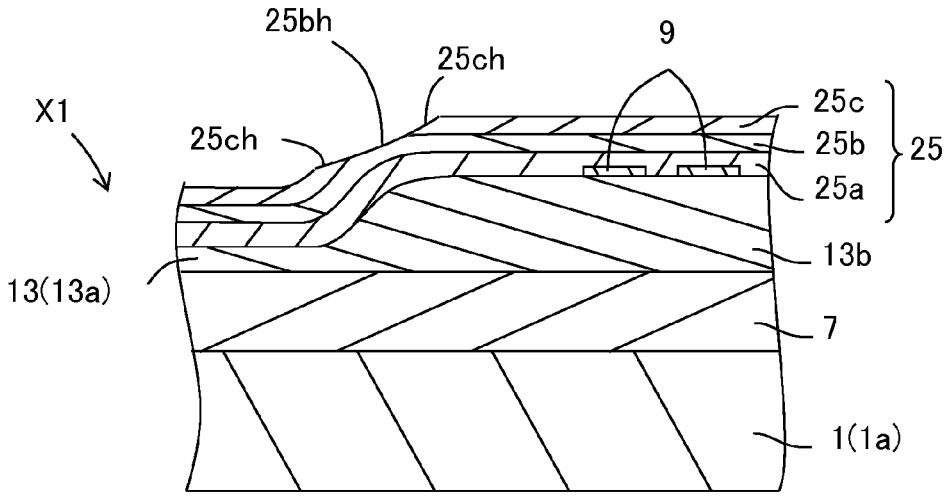
FIG. 8 is a cross-sectional view of the thermal head shown in FIG. 1 taken along the line IV-IV.

In more detail, the first protective layer 25 includes an electrical insulating layer 25*a* formed on the thermal storage layer 13, a conductive layer 25*b* formed on the electrical insulating layer 25*a* and an abrasion resistance layer 25*c* formed on the conductive layer 25*b* as shown in FIGS. 7 and 8.

The electrical insulating layer 25*a* covers the heat-generating portions 9 formed on the thermal storage layer 13 and also covers the common electrode 17 and the individual electrodes 19 connected to the heat-generating portions 9 though not shown in FIGS. 7 and 8 (refer to FIG. 2). The electrical insulating layer 25*a* is made of a material having high electrical insulation performance, for example, can be made of $Si_3N_4$, SiON and the like. As the electrical insulating layer 25*a* has the electrical insulation performance, it is possible to suppress short-circuit between the common electrode 17 and the individual electrodes 19 even when covering the common electrode 17 and the individual electrodes 19 as described above. Additionally, the electrical insulating layer 25*a* has a function of reducing oxidation of the common electrode 17, the individual electrodes 19 and the heat-generating portions 9. Note that the electrical insulating layer 25*a* may contain other elements such as Al or Y.

The conductive layer 25*b* is provided over the whole surface of the electrical insulating layer 25*a*, and the abrasion resistance layer 25*c* is provided on the conductive layer 25*b*. Then, part of the conductive layer 25*b* is exposed portions 25*bh* exposed from the abrasion resistance layer 25*c*. In the thermal head X1, the exposed portions 25*bh* are formed by the conductive layer 25*b* exposed from openings 25*ch* provided in the abrasion resistance layer 25*c*.

As shown in FIGS. 7 and 8, an opening 25*ch* provided in the abrasion resistance layer 25*c* and the exposed portion 25*bh* of the conductive layer 25*b* are provided on approximately the same surface. In other words, the outermost surface of the protective layer 25 is formed by an opening 25*ch* of the abrasion resistance layer 25*c* and the exposed portion 25*bh* of the conductive layer 25*b*.

The exposed portions 25*bh* are provided on a line extended from a row composed of the plurality of heat-generating portions 9 at portions positioned at both end portions in the arrangement direction in a plan view of the thermal head X1. An outside shape of the opening 25*ch* and the exposed portion 25*bn* is a triangular shape in a plan view. Here, as a general idea, the triangular shape is not limited to a shape formed by connecting three points respectively by segments but includes a shape in which corner portions connecting sides forming the triangle are rounded.

The triangular shape of the exposed portions 25*bh* is preferably an isosceles triangle extending toward the outside of the arrangement direction as shown in FIG. 1. As the shape of the exposed portions 25*bh* is the isosceles triangle in a plan view, it is possible to easily check whether a platen roller contacts the first protective film 25 on the heat-generating portions 9 without deviation in a conveying direction of the medium (hereinafter may be referred to as a conveying direction) or not. That is, when the shape of the exposed portions 25*bh* is not the isosceles triangle in a plan view, there is a possibility that the platen roller contacts the first protective film 25 on the heat-generating portions 9 in a deviated state. In the thermal head X1, the degree of contact between the platen roller and the first protective film 25 on the heat-generating portions 9 can be checked by checking the shape of the exposed portions 25*bh* in a plan view, as a result, a defect can be detected.

Then, the conductive layer 25*b* is electrically connected to the ground electrode 21 via through holes (not shown) provided in the electrical insulating layer 25*a* and is held in a ground potential. It is also preferable that the conductive layer 25*b* is electrically connected to the common electrode 17, not the ground electrode 21. According to the above structure, static electricity relieved from the medium to the conductive layer 25*b* can be discharged more positively. It is also preferable that the electrical insulating layer 25*a* positioned on the common electrode 17 or the individual electrodes 19 is partially removed by exposure or by forming notches to be electrically connected, not via through holes.

The conductive layer 25*b* is made of a material having conductivity, which can be made of, for example materials such as TaSiO, Al and Cu. When the conductive layer 25*b* is made of TaSiO, the specific resistance will be $2.3\times10^{-5}$ (Ω·m), when the conductive layer 25*b* is made of Al, the specific resistance will be $2.65\times10^{-8}$ (Ω·m), and when the conductive layer 25*b* is made of Cu, the specific resistance will be $1.68\times10^{-8}$ (Ω·m). It is also preferable to form the conductive layer 25*b* by Ag or Au.

Accordingly, when the medium on which printing is performed contacts the exposed portion 25*bh* as described later, static electricity accumulated in the medium can be relieved to the conductive layer 25*b* held in the ground potential or the positive potential. Accordingly, it is possible to reduce dielectric breakdown of the protective film 25*c* on the heat-generating portions 9 and to reduce damage of the heat-generating portions 9.

The abrasion resistance layer 25*c* is made of a material having higher abrasion resistance than the conductive layer 25*b*, which can be made of, for example, SiC, $Si_3N_4$ and so on. When the abrasion resistance layer 25*c* is made of SiC, Vickers hardness will be 2000 to 2200 Hv, and when the abrasion resistance layer 25*c* is made of $Si_3N_4$, Vickers hardness will be 1600 to 1800 Hv. The abrasion resistance layer 25*c* has higher abrasion resistance as described above, therefore, the abrasion of the entire protective film 25 can be suppressed as well as abrasion of the conductive layer 25*b* interposed between the electrical insulating layer 25*a* and the abrasion resistance layer 25*c* can be suppressed. As the abrasion resistance layer 25*c* is formed on the conductive layer 25*b* of the protective film 25 as described above, it is possible to reduce abrasion of the conductive layer 25*b*. Accordingly, the abrasion of the conductive layer 25*b* can be reduced as well as damage of the heat-generating portions 9 can be reduced when applying the thermal head X1 according to the embodiment.

Additionally, the abrasion resistance layer 25*c* has the opening 25*ch*, and part of the conductive layer 25*b* exposed from the opening 25*ch* is the exposed portion 25*bh*, therefore, it is possible to reduce the possibility that the periphery of the exposed portion 25*b* is abraded. Furthermore, as the abrasion resistance layer 25*c* is provided so as to surround the exposed portion 25*bh*, it is possible to reduce the possibility that the exposed portion 25*bh* contacts the medium frequently and to reduce the abrasion of the exposed portion 25*bh*. Also in the case where the exposed portion 25*bh* is provided so as to be surrounded by the abrasion resistance layer 25*c* as described above, static electricity accumulated in the medium can be discharged and damage of the heat-generating portions 9 can be reduced when the exposed portion 25*bh* contacts the medium at a predetermined frequency during printing of the thermal head X1.

The abrasion resistance layer 25*c* has the openings 25*ch* on the line extended from the row composed of the plurality of heat-generating portions 9 and part thereof is the exposed portions 25*bh* in which the conductive layer 25*b* is exposed from the openings 25*ch* as shown in FIGS. 1, 4, 7 and 8. Accordingly, it is possible to allow the medium on which printing is performed to contact the conductive layer 25*b* through the openings 25*ch* when performing printing by using the thermal head X1 according to the present embodiment. That is, for example, when the medium on which printing is performed is pressed onto the plurality of heat-generating portions 9 by the platen roller, it is possible to allow the platen roller to be further positioned on the openings 25*ch* of the abrasion resistance layer 25*c* formed on the line extended from the row while positioned on the row composed of the plurality of heat-generating portions 9. Accordingly, it is possible to press the medium onto the conductive layer 25*b* exposed from the openings 25*ch* of the abrasion resistance layer 25*c* while pressing the medium on the plurality of heat-generating portions 9 by the platen roller. Accordingly, the medium is allowed to contact the exposed portion 25*bh* of the conductive layer 25*b*.

Additionally, the openings 25*ch* of the abrasion resistance layer 25*c* are formed on both end portions of the raised portion 13*b* of the thermal storage layer 13 extending along the arrangement direction of the plurality of heat-generating portions 9. When the openings 25*ch* are disposed in this manner, the medium is allowed to contact the conductive layer 25*b* easily. That is, the raised portion 13*b* of the thermal storage layer 13 extends along the arrangement direction of the heat-generating portions 9 in the present embodiment. Accordingly, for example, when the medium is pressed onto the plurality of heat-generating portions 9 by the platen roller, the medium is pressed with greater force on both end portions than on the center portion of the raised portion 13*b* in which the heat-generating portions 9 are arranged. Accordingly, the medium is allowed to contact the exposed portions 25*bh* of the conductive layer 25*b* exposed from the openings 25*ch*.

When the electrical insulating layer 25*a*, the conductive layer 25*b* and the abrasion resistance layer 25*c* are formed as the first protective layer 25 by sequentially stacking these components in this order, it is possible to reduce the possibility that the covered heat-generating portions 9, part of the common electrode 17 and the individual electrodes 19 are oxidized due to reaction with oxygen or to reduce the possibility that these portions are corroded due to adhesion of moisture included in the air and the like. The electrical insulating layer 25*a*, the conductive layer 25*b* and the abrasion resistance layer 25*c* forming the first protective layer 25 can be formed by a well-known thin-film forming technique such as sputtering or deposition, or by using a thick-film forming technique such as screen printing. Additionally, the openings 25*ch* of the abrasion resistance layer 25*c* can be formed by, for example, polishing the abrasion resistance layer 25*c* from the surface to thereby punch holes.

Furthermore, the openings 25*ch* in the abrasion resistance layer 25*c* are formed on both end portions of the raised portion 13*b* of the thermal storage layer 13 extending along the arrangement direction. Accordingly, as the medium is pressed by the platen roller with great force on both end portions of the raised portion 13*b* as described above, the medium is allowed to contact the conductive layer 25*b* exposed from the openings 25*ch* easily. Consequently, static electricity generated in the medium can be positively relieved by the conductive layer 25*b*.

Moreover, as the exposed portions 25*b* are formed on both end portions of the raised portion 13*b* in the arrangement direction, the possibility that the exposed portions 25*b* contacts the medium can be increased and static electricity accumulated in the medium can be relieved through the conductive layer 25*b*.

Furthermore, the openings 25*ch* of the abrasion resistance layer 25*c* are formed on both end portions of the raised portion 13*b* of the thermal storage layer 13 extending along the arrangement direction of the plurality of heat-generating portions 9. Accordingly, as the medium is pressed by the platen roller with great force on both end portions of the raised portion 13*b* as described above, the recording medium is allowed to contact the conductive layer 25*b* exposed from the openings 25*ch* easily. Consequently, static electricity generated in the medium can be positively relieved by the conductive layer 25*b*.

As shown in FIGS. 1 to 4, a second protective film 27 partially covering the common electrode 17, the individual electrodes 19, the IC-control electrodes 23 and the ground electrode 21 is provided above the thermal storage layer 13 formed on the upper surface of the substrate 7. In the shown example, the second protective film 27 is provided so as to partially cover a region of approximately the right half of the upper surface of the thermal storage layer 13. The second protective film 27 is provided for protecting the covered common electrode 17, the individual electrodes 19, the IC control electrodes 23 and the ground electrode 21 from oxidation due to contact with the air and corrosion due to adhesion of moisture included in the air and so on. The second protective film 27 is formed so as to overlap with an end portion of the first protective layer 25 for securing the protection of the common electrode 17, the individual electrodes 19 and the IC-control electrodes 23. The second protective film 27 can be made of, for example, resin materials such as epoxy resin and polyimide resin. Additionally, the second protective film 27 can be formed by using the thick-film forming technique such as the screen printing.

Additionally, openings (not shown) for exposing end portions of the individual electrodes 19 connecting the driver ICs 11, the second intermediate regions 21N and the third intermediate region 21L of the ground electrode 21 as well as end portions of the IC control electrodes 23 are formed in the second protective film 27, and these wirings are connected to the driver ICs 11 through the openings. The driver ICs 11 are sealed by being covered with a covering member 29 made of resin such as epoxy resin or silicone resin for protecting the driver ICs 11 themselves and connecting portions between the driver ICs 11 and these wirings in a state of being connected to the individual electrodes 19, the ground electrode 21 and the IC-control electrodes 23.

As shown in FIG. 6, the FPC 5 is connected to the common electrode 17, the ground electrode 21 and IC-control electrodes 23. The FPC 5 is a well-known board in which a plurality of printed wirings are disposed inside an insulating resin layer, in which the respective printed wirings are electrically connected to an external power supply device, a controller and the like (not shown) through a connector 31 (refer to FIG. 1 and FIG. 6).

In more detail, in the FPC 5, the respective printed wirings formed thereinside are respectively connected to end portions of the sub-wiring portions 17*b* of the common electrode 17, end portions of the ground electrode 21 and end portions of the IC-control electrodes 23 by solder 33 (refer to FIG. 3). These wirings 17, 21 and 23 and the connector 31 are connected to one another. Then, when the connector 31 is electrically connected to the external power supply device, the controller and the like (not shown), the common electrode 17 is connected to a positive-side terminal of the power supply device which is held, for example, in a positive potential of 20 V to 24 V. Moreover, the individual electrodes 19 are electrically connected to a negative-side terminal of the power supply device which is held, for example, in a ground potential of 0 to 1 V. Accordingly, it is configured such that electric current is supplied to the heat-generating portions 9 and the heat-generating portions 9 generate heat when the switching devices of the driver ICs 11 are in the on-state.

Moreover, when the connector 31 is electrically connected to the external power supply device, the controller and the like (not shown), the IC power electrodes 23*a* of the IC control electrodes 23 are connected to the positive-side terminal of the power supply device held in the positive potential in the same manner as the common electrode 17. Accordingly, electric current for operating the driver ICs 11 is supplied to the driver ICs 11 by the difference of potentials in the IC power electrodes 23*a* to which the driver ICs 11 are connected and the ground electrode 21. The IC signal electrodes 23*b* of the IC control electrodes 23 are connected to the controller performing control of the driver ICs 11. Accordingly, a control signal from the controller is transmitted to the driver IC 11 through the end-portion signal electrode portion 23*b*E, and the control signal transmitted to the driver IC 11 is further transmitted to the adjacent driver IC 11 through the intermediate signal electrode portion 23*b*M. The on/off states of the switching devices inside the driver ICs 11 are controlled by the control signal, thereby allowing the heat-generating portions 9 to generate heat selectively.

Figure 9:
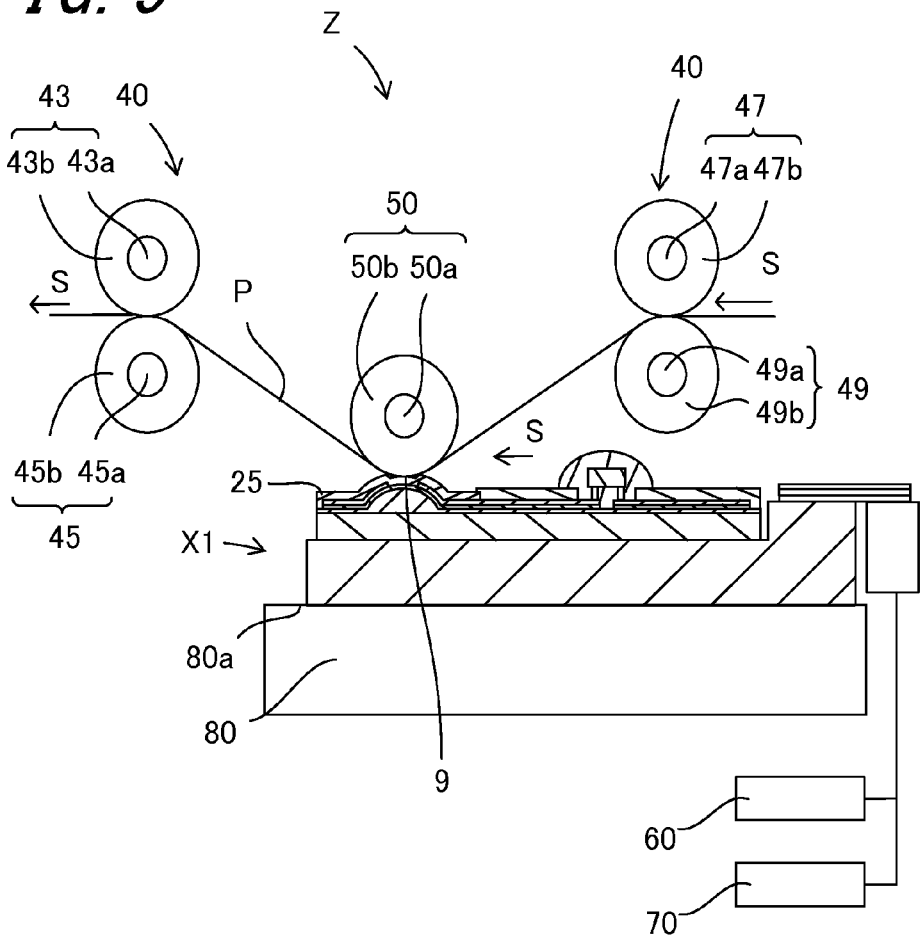
FIG. 9 is a schematic view showing a schematic structure of a thermal printer according to an embodiment of the invention.

Next, a thermal printer according to an embodiment of the invention will be explained with reference to FIG. 9. FIG. 9 is a schematic structure view of a thermal printer Z according to the present embodiment. Note that a measuring device (see FIG. 10) is not shown in FIG. 9.

As shown in FIG. 9, the thermal printer Z according to the present embodiment includes the above-described thermal head X1, a conveyance mechanism 40, a platen roller 50, a power supply device 60 and a controller 70. The thermal head X1 is attached to an attachment surface 80*a* of an attachment member 80 provided in a casing (not shown) of the thermal printer Z. The thermal head X1 is attached to the attachment member 80 so that the arrangement direction of the heat-generating portions 9 is along a direction orthogonal to a conveying direction S of a later-described medium P.

The conveyance mechanism 40 is provided for conveying the medium P such as heat-sensitive paper and receiver paper on which ink is transferred in a direction of an arrow S in FIG. 9 to be conveyed on the plurality of heat-generating portions 9 of the thermal head X1, having conveyance rollers 43, 45, 47 and 49. The conveyance rollers 43, 45, 47 and 49 can be formed by, for example, coating cylindrical shafts 43*a*, 45*a*, 47*a* and 49*a* made of a metal such as stainless steel with elastic members 43*b*, 45*b*, 47*b* and 49*b* made of butadiene rubber or the like. When the medium P is the receiver paper or the like on which ink is transferred, an ink film is conveyed together with the medium P between the medium P and the heat-generating portions 9 of the thermal head X1, though not shown.

The platen roller 50 is provided for pressing the medium P on the heat-generating portions 9 of the thermal head X1, which is disposed so as to extend along a direction orthogonal to the conveying direction S of the medium P, both end portions of which are supported so as to be rotated in a state of pressing the medium P on the heat-generating portions 9. The platen roller 50 can be formed by, for example, coating a cylindrical shaft 50*a* made of a metal such as stainless steel with an elastic member 50*b* made of butadiene rubber or the like.

In the present embodiment, the width of the medium P is wider than a length of the raised portion 13*b* of the thermal storage layer 13 in the thermal head X1. Additionally, a length of the platen roller 50 is longer than the length of the raised portion 13 of the thermal storage layer 13 in the thermal head X1. Accordingly, it is possible to press the medium P onto the exposed portions 25*bh* exposed from the openings 25*ch* of the abrasion resistance layer 25*c* positioned on both end portions of the raised portion 13*b* while pressing the medium P on the heat-generating portions 9 disposed on the raised portion 13*b*.

The power supply device 60 is provided for supplying electric current for allowing the heat-generating portions 9 of the thermal head X1 to generate heat and electric current for operating the driver ICs 11 as described above. The controller 70 is provided for supplying a control signal controlling the operation of the driver ICs 11 to the driver ICs 11 for allowing the heat-generating portions 9 of the thermal head X1 to generate heat selectively as described above.

The thermal printer Z according to the present embodiment can perform predetermined printing on the medium P by allowing the heat-generating portions 9 to generate heat selectively by the power supply device 60 and the controller 70 while pressing the medium P on the heat-generating portions 9 of the thermal head X1 by the platen roller 50 and conveying the medium P on the heat-generating portions 9 by the conveyance mechanism 40 as shown in FIG. 9. When the medium P is the receiver paper and so on, the printing on the medium P can be performed by thermally transferring ink of the ink film (not shown) conveyed with the medium P on the recording medium P.

Figure 10:
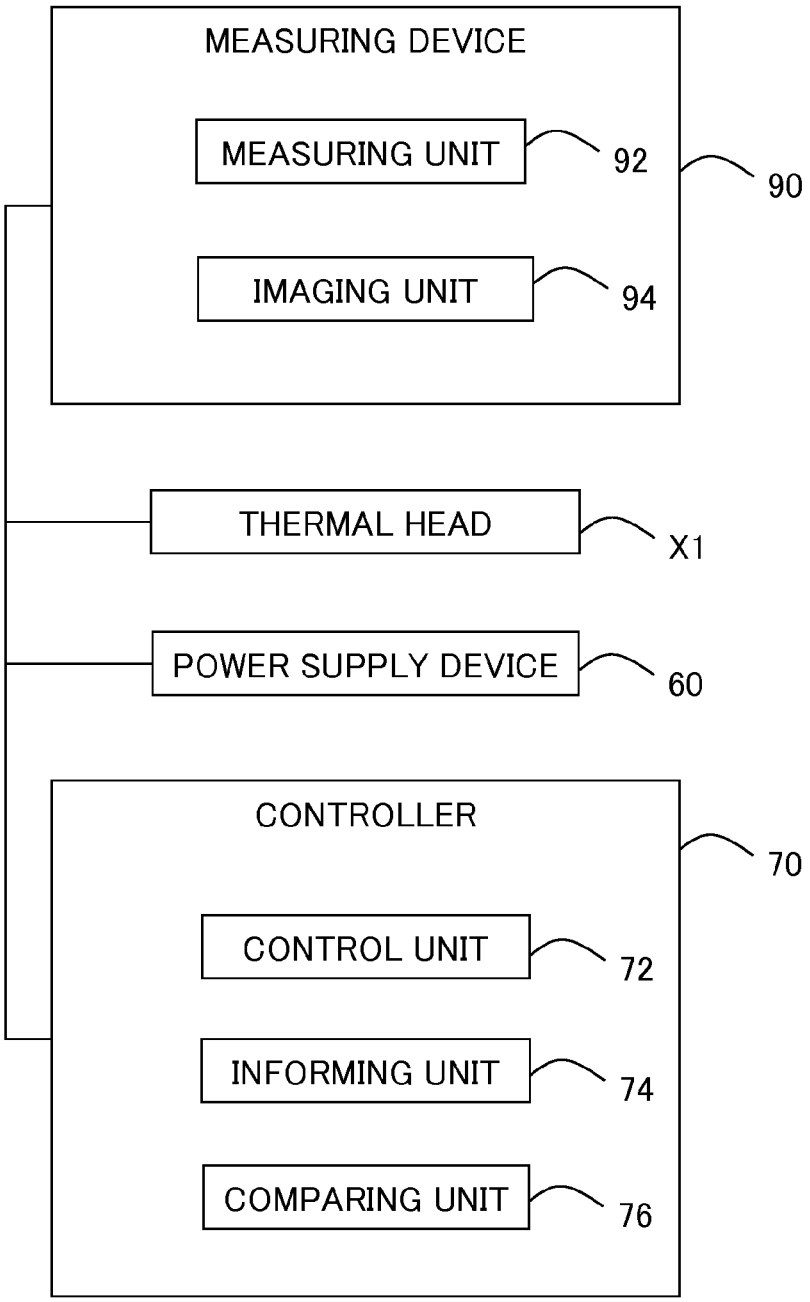
FIG. 10 is a block diagram showing a configuration of the thermal printer shown in FIG. 9.
Figure 11:
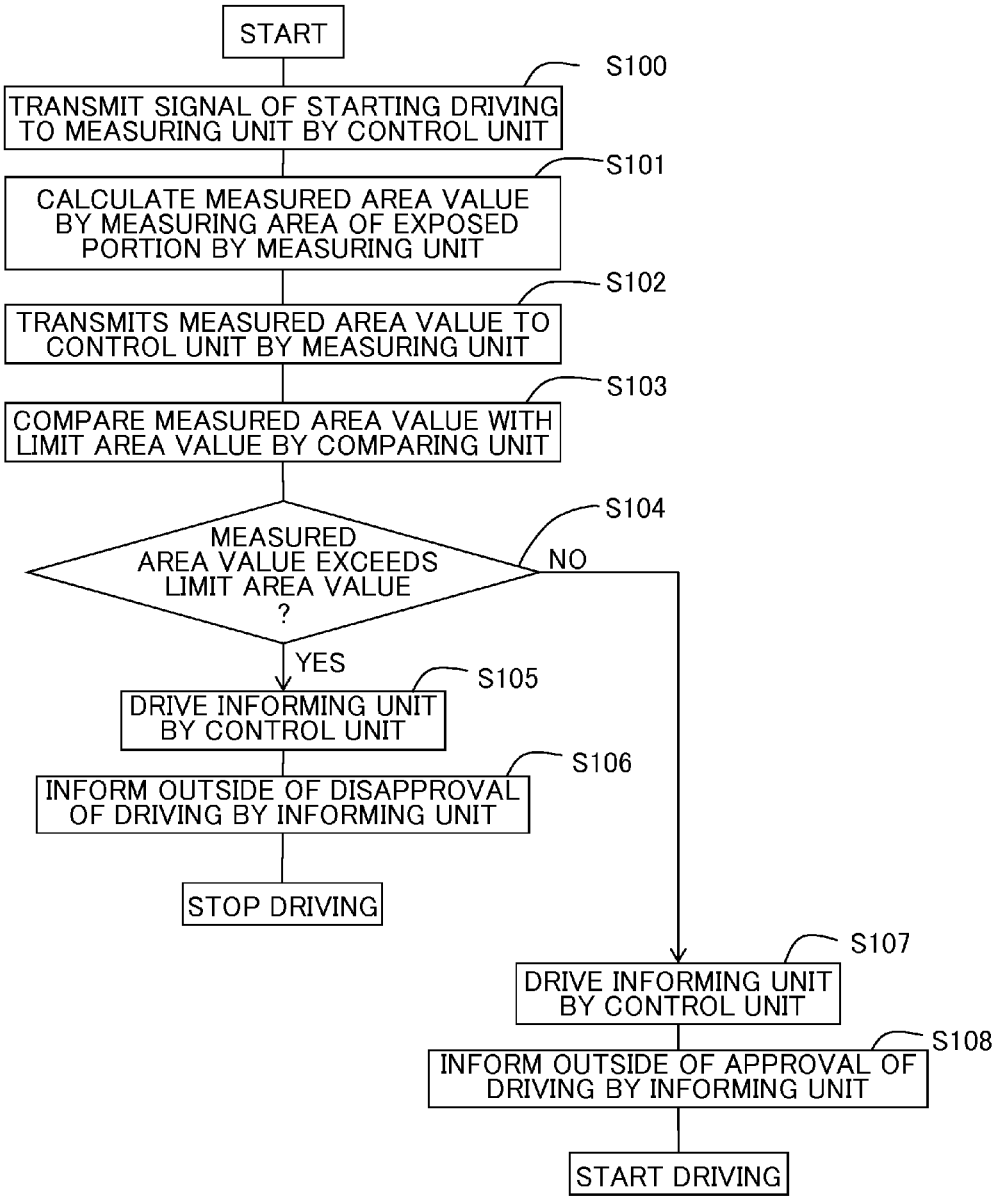
FIG. 11 is a flowchart showing a method of driving the thermal printer shown in FIG. 9.

A method of driving the thermal printer Z will be explained by using FIGS. 10 and 11.

The thermal printer Z includes the thermal head X1, the power supply device 60, the controller 70 and a measuring device 90. Then, the controller 70 informs outside of whether the thermal printer Z can be actuated or not based on an area value measured by the measuring device 90 at the time of starting driving of the thermal printer Z.

The controller 70 includes a control unit 72, an informing unit 74 and a comparing unit 76. The control unit 72 has a function of performing control of the thermal printer Z, which can apply, for example, a microcomputer mainly including a CPU, a ROM, a RAM and an input/output interface.

The informing unit 74 has a function of informing outside of whether the thermal printer Z can be actuated or not, displaying whether actuation can be performed or not on a display device (not shown) provided outside the thermal printer Z based on a signal transmitted by the control unit 72.

The comparing unit 76 compares a limit area value as a predetermined value which is stored in advance with a measured area value transmitted by the measuring unit, determining whether the measured area value exceeds the limit area value or not.

The measuring device 90 includes a measuring unit 92 measuring the area of the exposed portion 25*bh* and an imaging unit 94 taking an image of the exposed portion 25*bh*. As the measuring device 90, a camera module imaging the exposed portion 25*bh* can be exemplified. The measuring unit 92 calculates a measured area value by performing image processing of the image taken by the imaging unit 94.

The measuring device 90 is disposed above the thermal head X1 for taking the image of the exposed portion 25*bh*, which images the exposed portion 25*bh* from above by the imaging unit 94 to thereby calculate the measured area value. It is also preferable that the measuring device 90 is provided in a lateral direction and imaging is performed from the lateral direction.

Here, the limit area value used as the predetermined value stored in the comparing unit 76 will be explained.

The limit area value functions as a parameter indicating a degree of abrasion of the first protective film 25, which is a parameter different according to the medium P. These limit area values can be calculated by experiments or simulations.

The method of driving the thermal printer Z will be explained with reference to FIG. 11.

The thermal printer Z starts driving when information of the medium P and a signal indicating the start of driving are supplied from the outside. The control unit 72 transmits the signal indicating the start of driving to the measuring unit 92 based on the signal indicating the start of driving (S100).

The measuring unit 92 transmits a signal instructing the imaging unit 94 to take an image of the exposed portion 25*bh* based on the signal transmitted from the control unit 72. The imaging unit 94 takes the image of the exposed portion 25*bh* based on the signal transmitted by the measuring unit 92. Next, the imaging unit 94 digitally converts the taken image and supplies the image to the measuring unit 92. The measuring unit 92 performs predetermined image processing of the supplied digital data and calculates the measured area value obtained by measuring the area of the exposed portion 25*bh* (S101). Then, the measuring unit 92 transmits the obtained measured area value to the control unit 72 (S102).

The control unit 72 transmits the transmitted measured area value to the comparing unit 76. The comparing unit 76 compares the transmitted measured area value with the limit area value as the predetermined value stored in advance (S103).

When the measured area value exceeds the limit area value as the predetermined value, the comparing unit 76 transmits a signal indicating "measured area value>limit area value" to the control unit 72. The control unit 72 transmits a signal indicating disapproval of driving to the informing unit 74 based on the signal indicating "measured area value>limit area value". The control unit 72 further drives the informing unit 74 (S105).

The informing unit 74 displays disapproval of driving on the display device (not shown) based on the signal indicating disapproval of driving transmitted by the control unit 72 to thereby inform outside of the status in which the driving is not approved (S106).

The control unit 72 transmits the signal indicating disapproval of driving to the informing unit 74 as well as supplies a signal for stopping driving of the thermal printer Z to respective members to thereby stop the driving of the thermal printer Z.

When the measured area value does not exceed the limit area value as the predetermined value, the comparing unit 76 transmits a signal indicating "limit area value>measured area value" to the control unit 72. The control unit 72 transmits a signal indicating approval of driving to the informing unit 74 based on the signal indicating "limit area value>measured area value". The control unit 72 further drives the informing unit 74 (S107).

The informing unit 74 displays approval of driving on the display device (not shown) based on the signal indicating approval of driving transmitted by the control unit 72 to thereby inform outside of the status in which the driving is approved (S108).

The control unit 72 transmits the signal indicating approval of driving to the informing unit 74 as well as supplies a signal for starting driving of the thermal printer Z to respective members to thereby start the driving of the thermal printer Z.

When using the method of driving the thermal printer Z as described above, the degree of abrasion of the first protective film 25 can be detected before starting driving of the thermal printer Z as well as blur of printing or damage of the heat-generating portions 9 which may occur due to the abraded first protective film 25 can be reduced. It is also possible to detect the degree of abrasion of the first protection film 25 easily by detecting the degree of abrasion of the first protective film 25 by the area of the exposed portions 25*bh*.

One embodiment of the invention has been explained as the above, however, the invention is not limited to the above embodiment and various alterations may occur within a scope not departing from the gist thereof. Though the example in which the thermal head X1 is used for the thermal printer Z has been shown, it is also possible to use either of thermal heads X2 and X3. It is further possible to use thermal heads X1 to X3 according to plural embodiments in combination.

Figure 12:
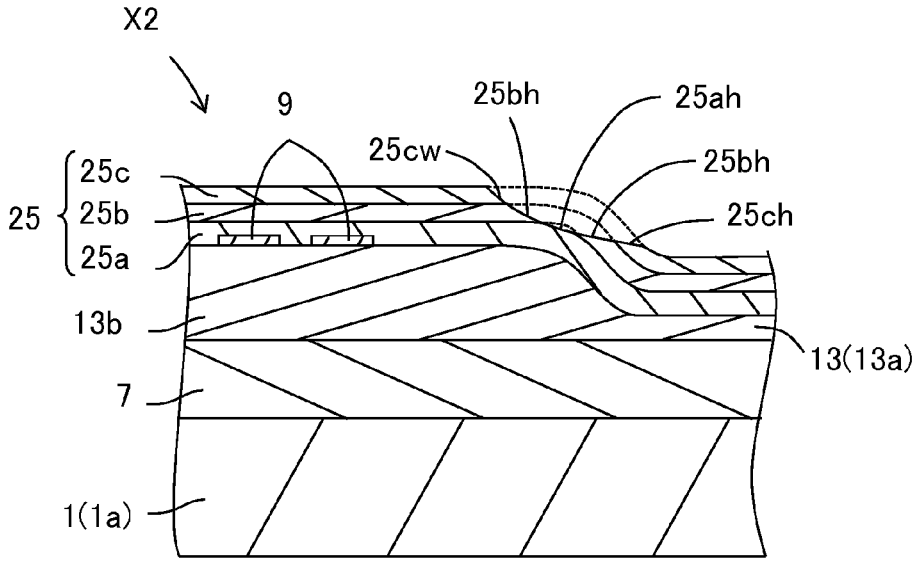
FIG. 12 is a cross-sectional view showing a modification example of the protective film shown in FIG. 7.

For example, the opening 25*ch* penetrating the abrasion resistance layer 25*c* is formed only in the abrasion resistance layer 25*c* in the thermal head X1 according to the embodiment as shown in FIGS. 7 and 8, however, it is not limited to the structure as long as the conductive layer 25*b* has the exposed portion 25*bh* from the opening 25*ch* of the abrasion resistance layer 25. As shown in FIG. 12, the exposed portion 25*bh* penetrating also the conductive layer 25*b* so as to be continuous to the opening 25*ch* is formed in addition to the opening 25*ch* of the abrasion resistance layer 25*c* in the thermal head X2. That is, the exposed portion 25*bh* may have a ring shape in a plan view. Also in this case, the medium is allowed to contact the conductive layer 25*b*. Even when the first protective layer 25 is abraded from the state of FIG. 7 to the state of FIG. 10 as used time of the thermal head X2 is increased, the medium is allowed to contact the exposed portions 25*bh* of the conductive layer 25*b*. In addition to the opening 25*ch* of the abrasion resistance layer 25*c* and the exposed portion 25*bh* of the conductive layer 25*b* shown in FIG. 12, an exposed portion 25*ah* penetrating the electrical insulating layer 25*a* may be formed in the electrical insulating layer 25*a* so as to be continuous to the opening 25*ch* and the exposed portion 25*bh*, though not shown.

Additionally, the first protective layer 25 is formed by a stacked body obtained by stacking three layers of the electrical insulating layer 25*a*, the conductive layer 25*b* and the abrasion resistance layer 25*c* in the thermal head X1 according to the embodiment as shown, for example, in FIGS. 7 and 8, however, the layer stack structure of the first protective layer 25 is not limited to the above as long as these three layers are stacked in this order from the substrate 7 side. For example, another layer may be interposed between the electrical insulating layer 25*a* and the conductive layer 25*b* or between the conductive layer 25*b* and the abrasion resistance layer 25*c*, though not shown. Another layer having the exposed portion continuing to the opening 25*ch* of the abrasion resistance layer 25*c* may be formed over the abrasion resistance layer 25*c*.

Figure 4:
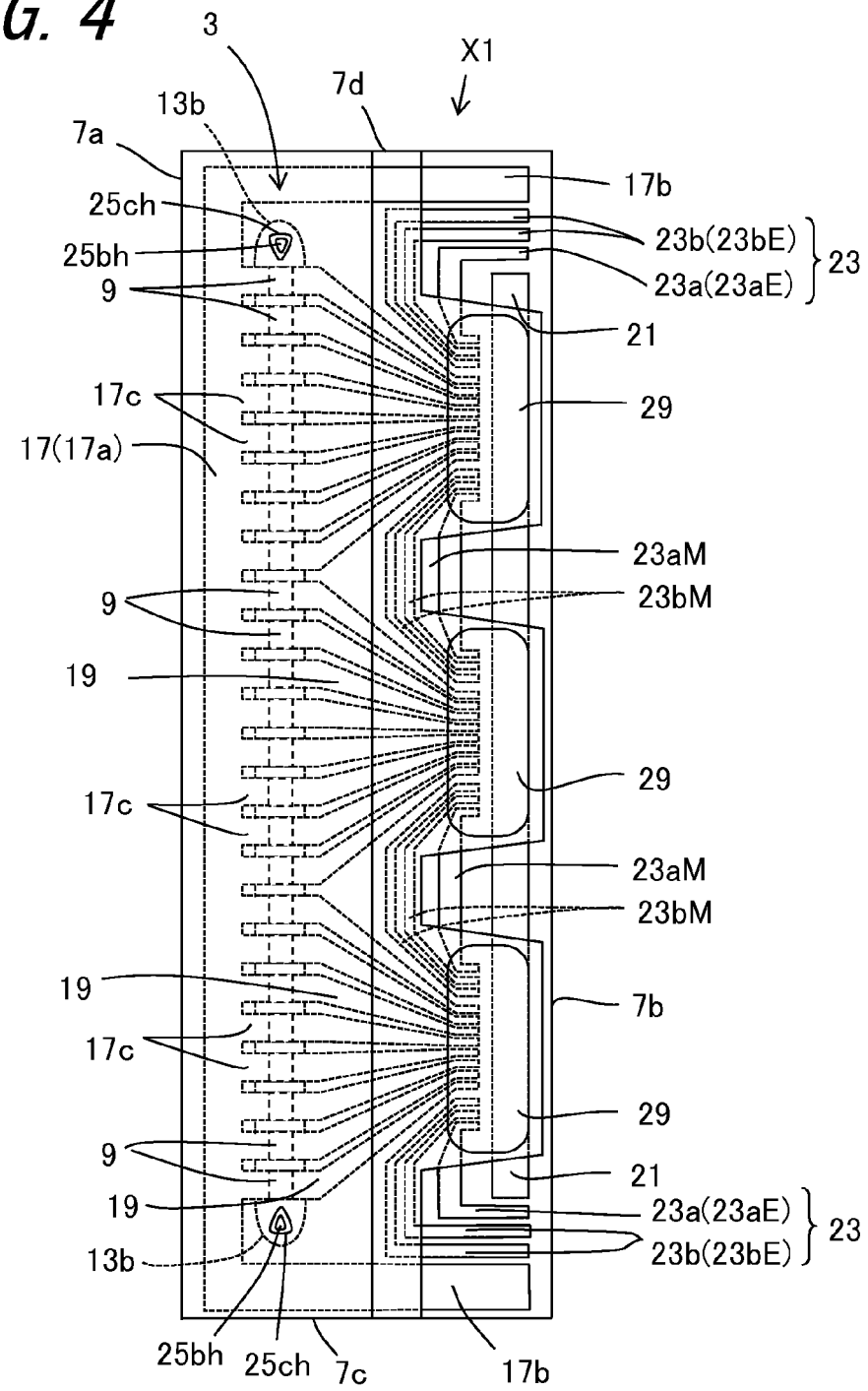
FIG. 4 is a plan view of a head base constituting the thermal head shown in FIG. 1.

Though the openings 25*ch* of the abrasion resistance layer 25*c* are formed on both end portions of the raised portion 13*b* of the thermal storage layer 13 in the thermal head X1 according to the embodiment as shown, for example, FIGS. 1 and 4, it is not limited to the structure. For example, the opening 25*ch* may be formed only in one of the end portions of the raised portion 13*b*.

Additionally, in the thermal storage layer 13, the raised portion which is partially raised on the substrate 7 is formed by providing the raised portion 13*b* partially raised from the base portion 13*a* on the base portion 13*a* in the thermal head X1 according to the embodiment as shown, for example, FIGS. 1, 4, 7 and 8, however, the structure of the thermal storage layer 13 is not limited to the above. For example, the thermal storage layer 13 may be formed only by the raised portion 13*b* without providing the base portion 13*a*.

Further, the thermal storage layer 13 may be formed only by the base portion 13*a* without providing the raised portion 13*b*. The thermal storage layer 13 itself may not be formed on the substrate 7. Even when the thermal head X1 is configured as the above, the medium is allowed to contact the exposed portions 25*ch* by the platen roller as described above.

Figure 13:
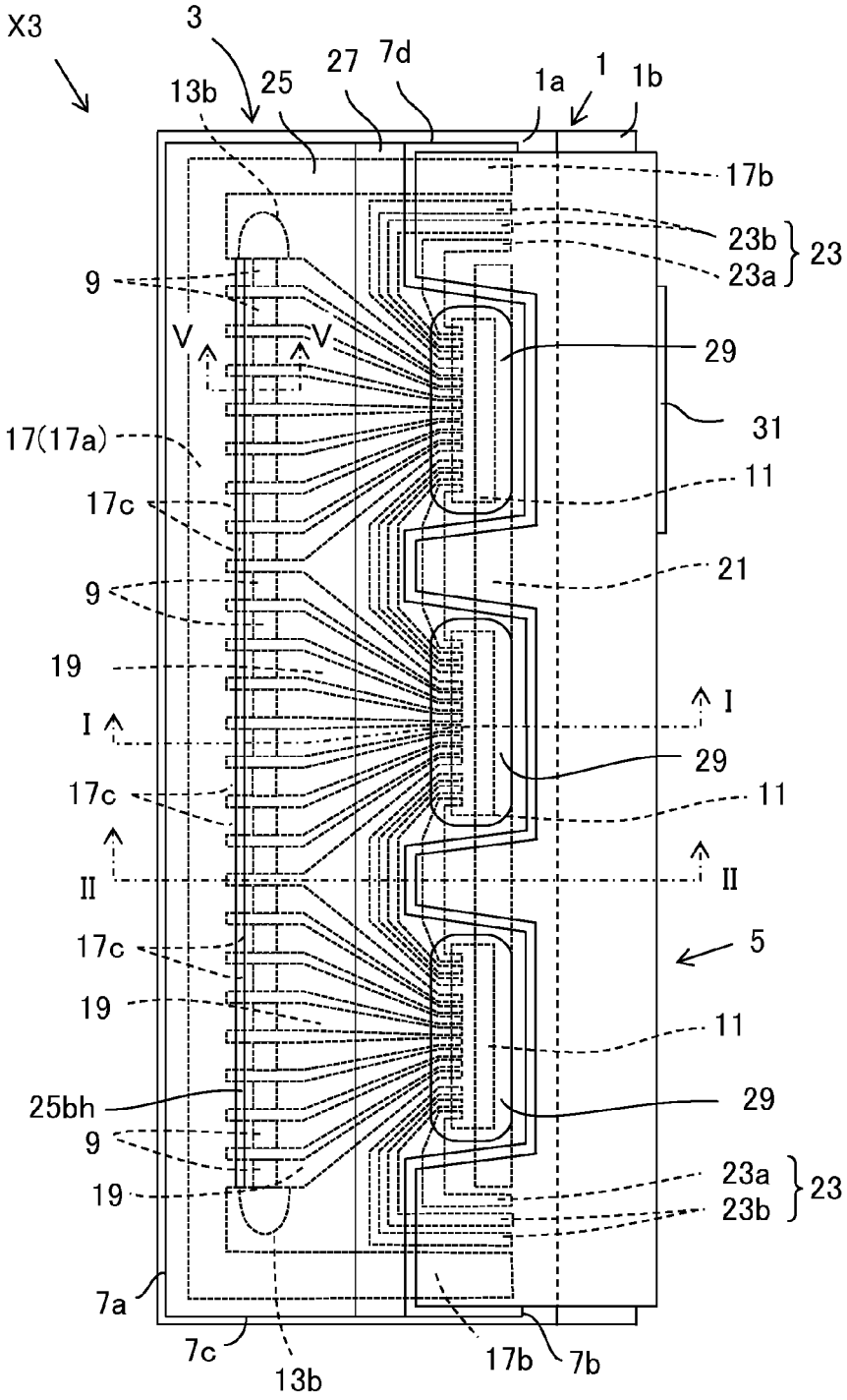
FIG. 13 is a plan view showing a thermal head according to another embodiment of the invention.

A thermal head X3 according to another embodiment of the invention will be explained with reference to FIGS. 13 and 14. The same components as the thermal head X1 are denoted by the same reference numerals and the explanations thereof are omitted.

In the thermal head X3, the exposed portion 25*bh* of the conductive layer 25*b* extends along the arrangement direction as well as provided on the downstream side of the heat-generating portions 9 in the conveying direction. The exposed portion 25*bh* is provided on the raised portion 13*b* of the thermal storage layer 13, which is provided adjacent to the heat-generating portions 9 over a region from the heat-generating portions 9 positioned at one end in the arrangement direction toward the heat-generating portions 9 positioned at the other end.

Figure 14:
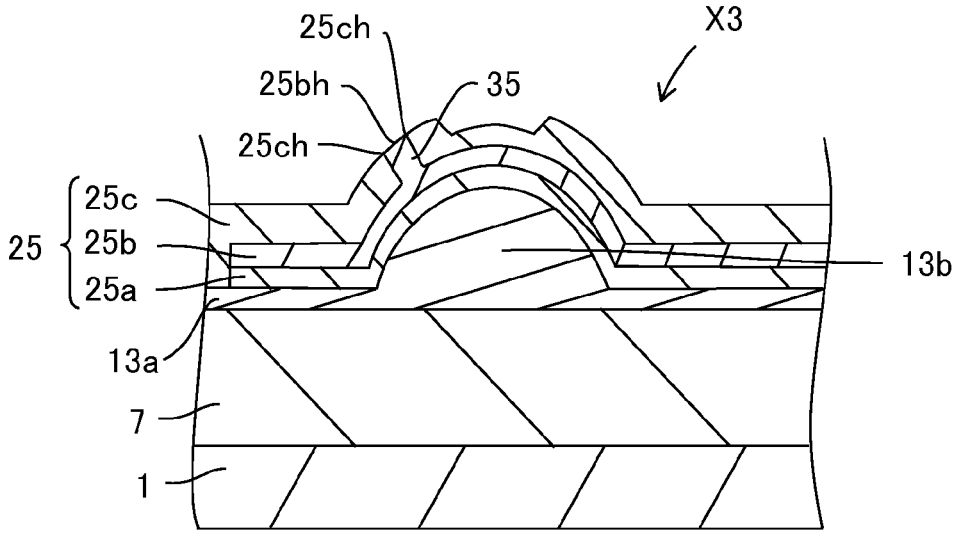
FIG. 14 is a cross-sectional view of the thermal head shown in FIG. 13 taken along the line V-V.

As shown in FIG. 14, the conductive layer 25*b* includes a protruding portion 35 protruding outwardly, and the exposed portion 25*bh* in which the conductive layer 25*b* is exposed is formed by the protruding portion 35. In other words, the protruding portion 35 is provided at the opening 25*ch* of the abrasion resistance layer 25*c*, and the protruding portion 35 exposed from the opening 25*ch* is the exposed portion 25*bh*. Then, the abrasion resistance layer 25*c* is provided on both sides of the exposed portion 25*bh*, and the surface of the abrasion resistance layer 25*c* and the exposed portion 25*bh* form approximately the same plane. Accordingly, the exposed portion 25*bh* contacts the medium, which can relieve static electricity accumulated in the medium.

Additionally, the exposed portion 25*bh* is provided on the downstream side of the heat-generating portions 9 in the conveying direction, therefore, the medium can be peeled off from the thermal head X3 efficiently after relieving static electricity by the exposed portion 25*bh*.

The example in which the exposed potion 25*bh* and the surface of the abrasion resistance layer 25*c* form approximately the same plane in the thermal head X3 has been shown, however, the structure is not limited to this. For example, the exposed portion 25*bh* may be provided at a lower position than the surface formed by the abrasion resistance layer 25*c*. In other words, the exposed portion 25*bh* may form a concaved portion (not shown). Also in this case, as the platen roller is made of rubber as described above, the roller can contact the exposed portion 25*bh* by deformation of rubber, which can relieve static electricity accumulated in the medium. It is also possible to reduce the possibility that the exposed portion 25*bh* contacts the medium excessively by forming the concave portion by the exposed portion 25*bh*. The depth of the concave portion may be appropriately set in accordance with the hardness of rubber used in the platen roller.

The exposed portion 25*bh* may also be provided at a higher position than the surface formed by the abrasion resistance layer 25*c*. In other words, the exposed portion 25*bh* may form a convex portion (not shown). In this case, it is possible to allow the exposed portion 25*gh* to contact the medium without being abraded particularly when the hardness of rubber in the platen roller is low, which can reduce damage of the heat-generating portions 9.

The thermal heads X1 to X3 in which the opening 25*ch* is provided in the abrasion resistance layer 25*c* and part of the conductive layer 25 exposed from the opening 25*ch* is the exposed portion 25*bh* have been exemplified, however, the structure is not limited to the above. For example, when the conductive layer 25*b* is provided so that the area thereof is larger than the abrasion resistance layer 25*c* in a plan view, part of the conductive layer 25*b* can form the exposed portion 25*bh* exposed from the abrasion resistance layer 25*c*.

The method of driving the thermal head printer Z at the time of starting driving has been exemplified, the method is not limited to this. For example, abrasion amounts of the first protective layer 25 corresponding to areas of the exposed portion 25*bh* in respective media are calculated by experiments or simulations, thereby calculating the abrasion amount of the first protective layer 25 based on the measured area value of the exposed portion 25*bh*.

Specifically, a data table including areas of the exposed portion 25*bh* and abrasion amounts of the first protective layer 25 corresponding to the areas of the exposed portion 25*bh* in respective media P is stored in the comparing unit 76 of the controller 70 in advance.

At the time of driving the thermal printer, the measuring unit 92 of the thermal printer Z transmits a signal instructing the imaging unit 94 to take an image of the exposed portion 25*bh* based on the signal transmitted from the control unit 72. The imaging unit 94 takes the image of the exposed portion 25*bh* based on the signal transmitted by the measuring unit 92. Next, the imaging unit 94 digitally converts the taken image and supplies the image to the measuring unit 92. The measuring unit 92 performs predetermined image processing of the supplied digital data and calculates the measured area value obtained by measuring the area of the exposed portion 25*bh*. Then, the measuring unit 92 transmits the obtained measured area value to the control unit 72.

The control unit 72 transmits the transmitted measured area value to the comparing unit 76. The comparing unit 76 calculates a measured abrasion amount as the abrasion amount of the first protective layer 25 by referring to the transmitted measured area value and the data table stored in advance. Then, the comparing unit 76 compares a limit abrasion amount as a limit value in the abrasion amount of the first protective layer 25 stored in the comparing unit 76 in advance with the measured area value.

When the measured abrasion amount exceeds the limit abrasion amount, the comparing unit 76 transmits a signal indicating "measured abrasion amount>limit abrasion amount" to the control unit 72. The control unit 72 transmits a signal indicating disapproval of driving to the informing unit 74 based on the signal indicating "measured abrasion amount>limit abrasion amount". The control unit 72 further drives the informing unit 74.

The informing unit 74 displays disapproval of driving on the display device (not shown) based on the signal indicating disapproval of driving transmitted by the control unit 72 to thereby inform outside of the status in which the driving is not approved.

The control unit 72 transmits the signal indicating disapproval of driving to the informing unit 74 as well as supplies a signal for stopping driving of the thermal printer Z to respective members to thereby stop the driving of the thermal printer Z.

When the measured abrasion amount does not exceed the limit abrasion amount, the comparing unit 76 transmits a signal indicating "limit abrasion amount>measured abrasion amount" to the control unit 72. The control unit 72 transmits a signal indicating approval of driving to the informing unit 74 based on the signal indicating "limit abrasion amount>measured abrasion amount". The control unit 72 further drives the informing unit 74.

The informing unit 74 displays approval of driving on the display device (not shown) based on the signal indicating approval of driving transmitted by the control unit 72 to thereby inform outside of the status in which the driving is approved.

The abrasion amount of the first protective layer 25 is calculated based on the measured area value of the exposed potion 25*bh* as described above, thereby detecting whether the thermal printer Z can be actuated or not, as a result, necessity of replacing the thermal head X1 can be checked.

Accordingly, it is possible to detect the abrasion amount of the first protective film 25 of the thermal head X1 and to check the necessity of replacing the thermal head X1 without measuring the abrasion amount of the first protective film 25 by dismounting the thermal head X1 from the thermal printer. Accordingly, the thermal printer Z with improved maintainability can be obtained.

Reference Signs List

X1, X2, X3: Thermal head
1: Heat dissipating member
3: Head base
7: Substrate
9: Heat-generating portion
13: Thermal storage layer
13*b:* Raised portion
15: Electric resistor layer
17: Common electrode
19: Individual electrode
25: First protective layer
25*a:* Electrical insulating layer
25*b:* Conductive layer
25*bh:* Exposed portion
25*c:* Abrasion resistance layer
25*ch:* Opening
27: Second protective film
70: Controller
90: Measuring device

What is claimed is;

1. A thermal head comprising:
a substrate;
a plurality of heat-generating portions disposed on or above the substrate;
electrodes provided on or above the substrate and electrically connected to the plurality of heat-generating portions; and
a protective layer covering the plurality of heat-generating portions and the electrodes,
the protective layer having an electrical insulating layer covering the plurality of heat-generating portions and the electrodes, a conductive layer provided on the electrical insulating layer, and an abrasion resistance layer provided on the conductive layer, and
part of the conductive layer being an exposed portion exposed from the abrasion resistance layer.

2. The thermal head according to claim 1,
wherein the abrasion resistance layer has an opening, and the exposed portion is exposed from the opening.

3. The thermal head according to claim 1,
wherein a surface of the exposed portion and a surface of the abrasion resistance layer are disposed on an approximately same plane.

4. The thermal head according to claim 1,
wherein the exposed portion is surrounded by the abrasion resistance layer.

5. The thermal head according to claim 1,
wherein part of the conductive layer comprises a protruding portion which protrudes toward an outside and constitutes the exposed portion.

6. The thermal head according to claim 1,
wherein an outside shape of the exposed portion is a triangular shape in a plan view thereof.

7. A thermal printer comprising:
the thermal head according to claim 1,
a conveyance mechanism that conveys a medium on the plurality of heat-generating portions; and
a platen roller that presses the medium on the plurality of heat-generating portions and the part of the conductive layer which is the exposed portion.

8. The thermal printer according to claim 7, further comprising:
an area measuring unit that measures an area of the exposed portion;
an informing unit that informs outside of whether the thermal printer can be actuated or not; and
a control unit that drives the informing unit,
wherein the control unit drives the informing unit when an area value indicating the area measured by the area measuring unit exceeds a predetermined value.

9. The thermal head according to claim 1,
wherein the exposed portion is provided on a line extended from a row composed of the plurality of heat-generating portions.

10. The thermal head according to claim 9, further comprising:
a thermal storage layer provided on the substrate,
wherein the thermal storage layer has a raised portion extending along an arrangement direction of the plurality of heat-generating portions as well as partially raised on the substrate,
the plurality of heat-generating portions are disposed on the raised portion, and
the exposed portion is provided on at least one of end portions of the raised portion.

11. The thermal head according to claim 10,
wherein the exposed portion is provided on each of both the end portions of the raised portion.

12. A thermal printer comprising:
the thermal head according to claim 9,
a conveyance mechanism that conveys a medium on the plurality of heat-generating portions; and
a platen roller that presses the medium on the plurality of heat-generating portions and the part of the conductive layer which is the exposed portion.

13. The thermal printer according to claim 12, further comprising:
an area measuring unit that measures an area of the exposed portion;
an informing unit that informs outside of whether the thermal printer can be actuated or not; and
a control unit that drives the informing unit,
wherein the control unit drives the informing unit when an area value indicating the area measured by the area measuring unit exceeds a predetermined value.

14. The thermal head according to claim 1,
wherein the exposed portion is provided on a downstream side with respect to the plurality of heat-generating portions in a conveying direction of a medium conveyed on the plurality of heat-generating portions.

15. The thermal head according to claim 14, further comprising:
a thermal storage layer provided on the substrate,
wherein the thermal storage layer has a raised portion extending along an arrangement direction of the plurality of heat-generating portions as well as partially raised on the substrate,
the plurality of heat-generating portions are disposed on the raised portion, and
the exposed portion is provided on at least one of end portions of the raised portion.

16. The thermal head according to claim 15,
wherein the exposed portion extends along the arrangement direction of the plurality of heat-generating portions.

17. A thermal printer comprising:
the thermal head according to claim 14, a conveyance mechanism that conveys a medium on the plurality of heat-generating portions; and a platen roller that presses the medium on the plurality of heat-generating portions and the part of the conductive layer which is the exposed portion.

18. The thermal printer according to claim 17, further comprising:

an area measuring unit that measures an area of the exposed portion;

an informing unit that informs outside of whether the thermal printer can be actuated or not; and a control unit that drives the informing unit, wherein the control unit drives the informing unit when an area value indicating the area measured by the area measuring unit exceeds a predetermined value.

* * * * *